US010121369B2

(12) United States Patent
Hofman

(10) Patent No.: US 10,121,369 B2
(45) Date of Patent: Nov. 6, 2018

(54) METHOD FOR TRAFFIC CONTROL

(71) Applicant: Ofer Hofman, Timrat (IL)

(72) Inventor: Ofer Hofman, Timrat (IL)

( * ) Notice: Subject to any disclaimer, the term of this patent is extended or adjusted under 35 U.S.C. 154(b) by 0 days.

(21) Appl. No.: 15/240,366

(22) Filed: Aug. 18, 2016

(65) Prior Publication Data

US 2017/0069204 A1 Mar. 9, 2017

Related U.S. Application Data

(60) Provisional application No. 62/215,320, filed on Sep. 8, 2015.

(51) Int. Cl.

| | |
|---|---|
| ***G08G 1/083*** | (2006.01) |
| ***G08G 1/042*** | (2006.01) |
| ***G08G 1/02*** | (2006.01) |
| ***G08G 1/04*** | (2006.01) |

(52) U.S. Cl.

CPC ..... *G08G 1/083* (2013.01); *G08G 1/02* (2013.01); *G08G 1/04* (2013.01); *G08G 1/042* (2013.01)

(58) Field of Classification Search

CPC ..... G08G 1/083; G08G 1/0145
USPC ..... 340/907
See application file for complete search history.

(56) References Cited

U.S. PATENT DOCUMENTS

2004/0012487 A1* 1/2004 Burns ..... G08B 5/36 340/332
2010/0171640 A1* 7/2010 Delia ..... G08G 1/07 340/907
2010/0321210 A1* 12/2010 Lee ..... G08G 1/081 340/917
2014/0139358 A1* 5/2014 Lee ..... G08G 1/092 340/907
2016/0027299 A1* 1/2016 Raamot ..... G08G 1/08 340/917

FOREIGN PATENT DOCUMENTS

KR 20090008964 A * 1/2009

OTHER PUBLICATIONS

Yang et al., Acyclic Real-Time Traffic Signal Control Based on a Genetic Algorithm, Cybernetics and Information Technologies, vol. 13, No. 3, Sofia 2013.
Subramaniam et al., Self-Algorithm Traffic Light Controllers for Heavily Congested Urban Route, WSEAS Transactions on Circuits and Systems, Issue 4, vol. 11, Apr. 2012.

* cited by examiner

*Primary Examiner* — Tanmay Shah
(74) *Attorney, Agent, or Firm* — Manelli Selter PLLC; Edward Stemberger

(57) ABSTRACT

Described is a method to optimize traffic light activity and minimize traffic congestion. Traffic conditions are monitored by sensors and a controller dynamically controls the green light time to account for traffic conditions and enhance the traffic flow. In one example, the green light time of each lane is reduced or increased according to traffic flow in the lane.

15 Claims, 4 Drawing Sheets

METHOD FOR TRAFFIC CONTROL

TECHNOLOGY FIELD

The present method relates to the field of traffic control and in particular to dynamic algorithms for determining traffic lights sequences to reduce traffic congestion.

BACKGROUND

Traffic light control is the most important and efficient method for controlling traffic in urban areas. There are three categories of traffic light control strategies: fixed-time control, traffic actuated control and traffic adaptive control. In fixed time control each traffic light has a predefined duration for allowing traffic to flow. The controller cycles between all the traffic signals. In this manner each lane gets a predefined duration of a green light and flow of traffic. As the rate of flow of traffic increases, the fixed time control may not provide the optimal division of time between the different lanes and traffic congestion may arise.

A remedy to the inefficiencies of fixed time traffic light control is to measure the traffic flow and change the traffic light duration according to measured traffic flow. Examples of measuring traffic flow include; wire loops embedded in the road which generates a current when a car passes over them; pressure sensitive devices embedded in the road; acoustic devices to measure traffic flow; and image based systems to measure traffic flow. Examples of existing algorithms are given in CYBERNETICS AND INFORMATION TECHNOLOGIES, Volume 13, No 3 DOI: 10.2478/cait-2013-0029 and Self-Algorithm Traffic Light Controllers for Heavily Congested Urban Route, WSEAS TRANSACTIONS on CIRCUITS and SYSTEMS, Issue 4, Volume 11, April 2012.

Existing solutions focus on the static measure of traffic. For example, a green traffic light is provided if the traffic sensor indicates the existence of a car in the relevant lane. To assess the amount of traffic in the lane these solutions require additional sensors which increases the cost of deployment and significantly increases the cost of operation. The required computing resources for some algorithms are not supported by existing traffic light controllers, so a deployment of some systems requires an overhaul of the existing infrastructure. Furthermore, the cited examples which dynamically change the traffic light duration based on static measurements also change the cycle of the traffic signal. Changing the cycle of the traffic light disrupts the flow of traffic and induces congestion across the road system. In some examples of state of art solutions, the applied methods can only reduce the preplanned maximum time for each light. In one example, if 20 seconds are allocated for a green light than the state of art method will reduce the allocated time from 20 seconds to a smaller number. Hence this will shorten the allocated green time to a specific lane, without an increase in green light time to other lanes. The inability to increase the allocated green light time to more than 20 seconds results in traffic congestion as demonstrated in this example. Assuming traffic is congested and requires 23 seconds to pass through the junction. If only 20 seconds are allocated than the remaining 3 seconds of traffic would be stopped for next green light cycle. In the next green light cycle, there will now be 23 seconds of traffic plus the 3 seconds from the previous cycle. Thus the traffic flow is impeded and congestion arises rapidly.

Hence an alternative algorithm is required. The desired algorithm should provide the following features:

Can be implemented in the existing infrastructure of controllers and single sensor per lane.

Maintains the traffic flow cycle to prevent disruption to traffic.

In some examples, the proposed algorithm can also increase the allocated green time beyond the static allocated green time.

DESCRIPTION

Figure 1:
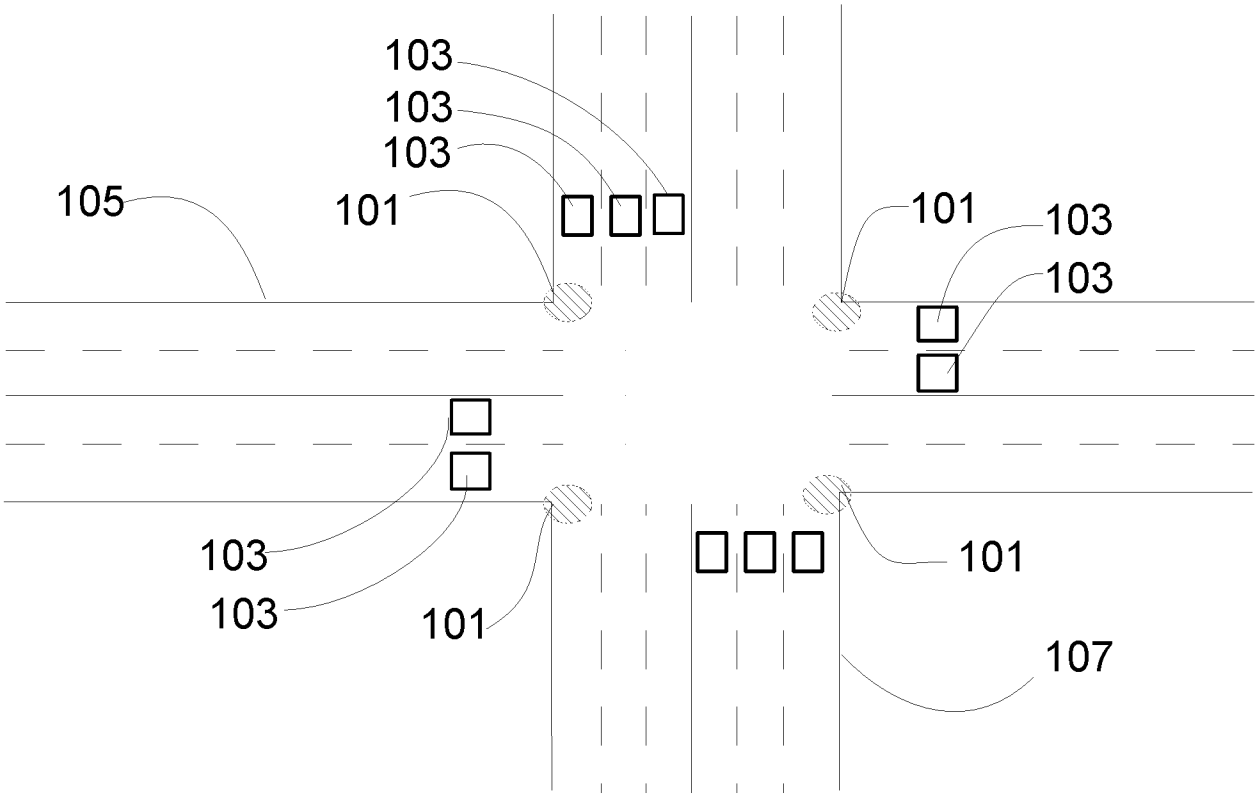
FIG. 1 is an example of a road intersection with traffic signals and lane sensors.

This document describes an algorithm and method for optimizing traffic light duration in a desired direction/lane and which overcomes the deficiencies of existing algorithms and methods. FIG. 1 is an example of a traffic intersection. The intersection is the area where two or more roads intersect. Road (105) and road (107) are examples of roads which intersect. In one example the traffic flow through the intersection is controlled by traffic lights (101). The traffic light (101) directs the traffic through the use of pre-designated signals such as light colors, or light shape. The traffic light (101) lighting pattern is designed so that at any given time, the traffic emanating from one lane would not intersect with traffic emanating from another lane. In a further example, traffic sensors (103) register the passage of an automobile over the sensor. Examples of traffic sensors (103) include; induction loops which generate current when a metal body such as an automobile passes over the sensor; Pressure or shear sensors which measure the weight of deformation caused by the passage of an automobile; Acoustic sensors which sense the passage of an automobile; Or image sensors which record and analyze the flow of traffic.

Figure 2:
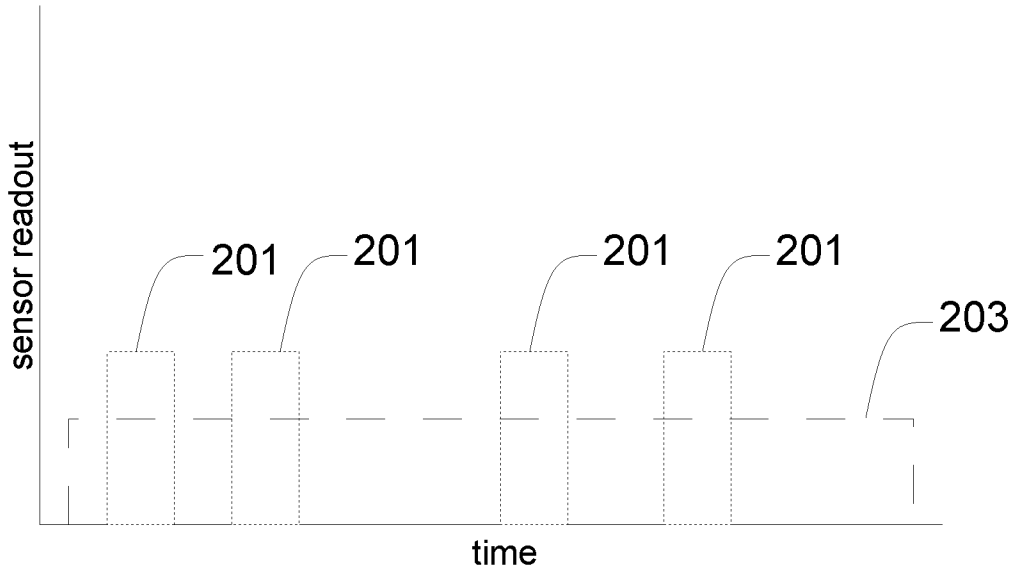
FIG. 2. is an example of a graph of sensor signal over time.

FIG. 2 is an example of a graph of sensor signal over time. The "x" axis depicts the time, while the "y" axis depicts the sensor signal. In one example, when an automobile traverses the sensor, the sensor will emit a signal event (201) which corresponds to the time of traversal. The period of a green signal, the green light time (203) is depicted as a dashed line. During the time the traffic light is green, several cars may traverse the sensor, hence FIG. 2 depicts several signal events (201), each signal event (201) corresponding to one automobile traversing the sensor. The "usage time" is defined as the sum of all signal events (201) in a lane. The "usage percentage" is defined as the "usage time" divided by the green light time (203).

Figure 3:
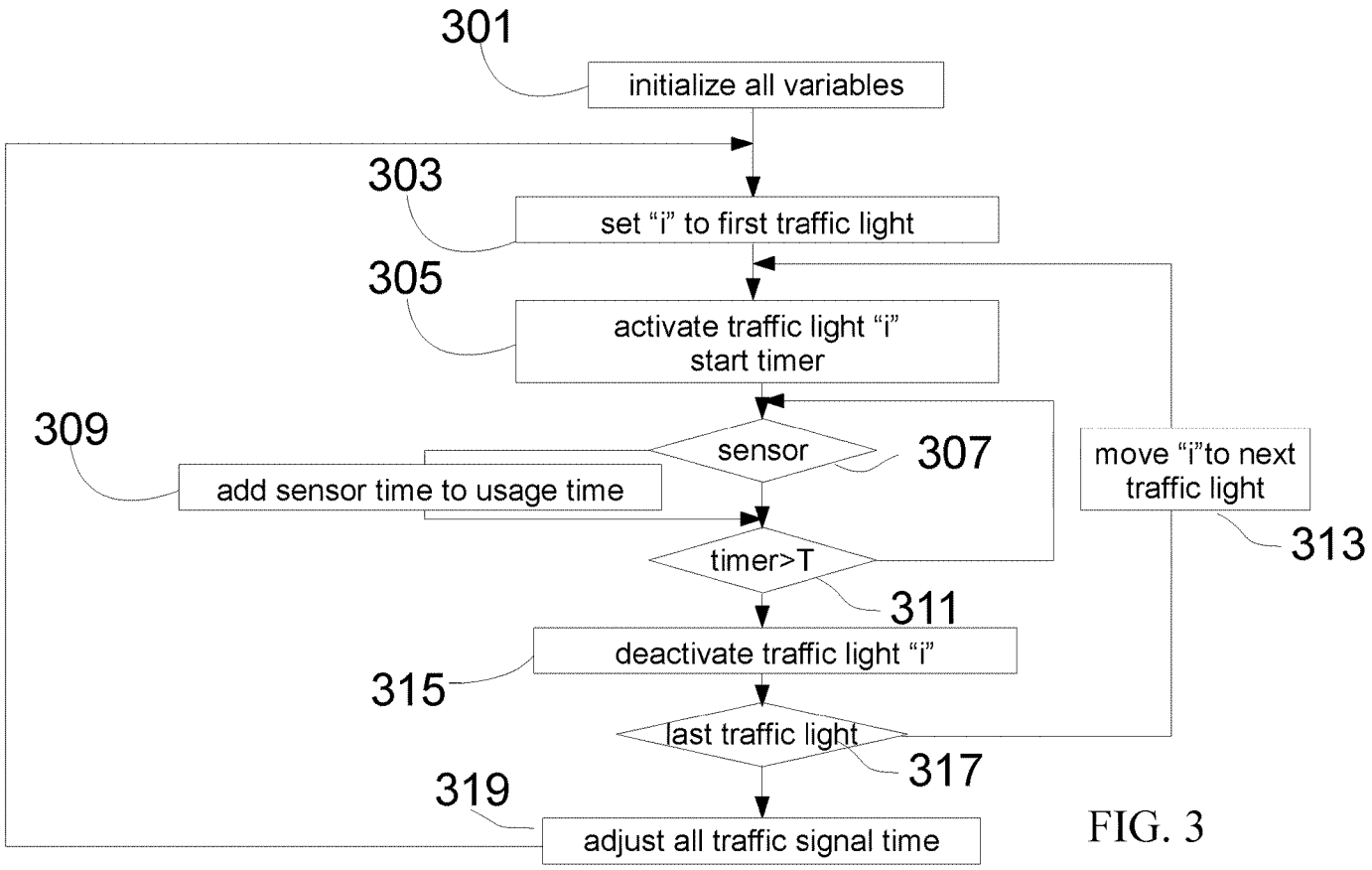
FIG. 3 is an example of an algorithm for optimizing traffic light duration.
Figure 4:
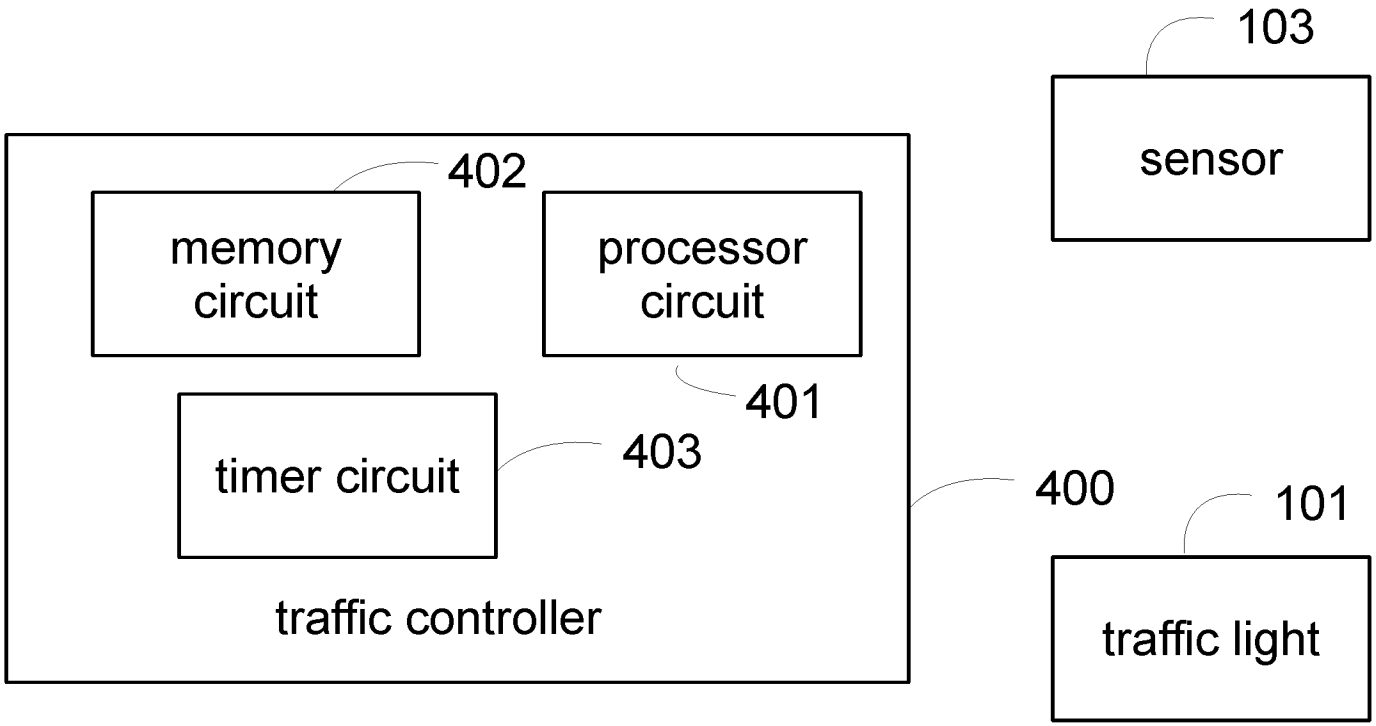
FIG. 4 is a block diagram of a circuit of the embodiment.

FIG. 3 is an example of an algorithm for optimizing the traffic flow and which does not suffer from the deficiencies of state of art algorithms. Block (301) of the algorithm initializes all the variables required for the algorithm. Examples of variables include; a counter for the traffic lights (e.g. "i"); a timer; a green light time (203 in FIG. 2) for each traffic light. Block (303) sets the traffic light counter (e.g. "i") to the first traffic light. This facilitates the main loop to start the traffic light cycle. Block (305) activates the designated traffic light (e.g. traffic light "i"). In one example, the activation is composed of a sequence of lights leading from a red light to a green light. In addition block (305) starts a timer circuit 403 (FIG. 4). The timer circuit or timer is used to limit the green light in the traffic light to the green light time (203 in FIG. 2). Block (307) measures the traffic through the sensor which is relevant for the designated traffic light (e.g. traffic light "i"). If the sensor measurement is positive then block (309) adds the time the sensor is positive to the usage time. If the sensor measurement is zero, then no time is added to the usage time. Block (311) compares the timer time to the green light time (e.g., time on, 203 in FIG. 2) of the designated traffic light (e.g. traffic light "i"). If the elapsed time is shorter than the green light time (203 in FIG. 2), block (307) is executed and the sensor is measured. If the elapsed time is greater than the green light time (203 in FIG. 2) the designated traffic light (e.g. traffic light "i") is deactivated (block 315). In one example, the deactivation is a sequence of light signals starting with green light and ending with a red light. Block (317) checks if the active traffic light is the last of the traffic lights. If the active traffic light is not the last, the traffic light counter (e.g. "i") is changed to reflect the next designated traffic light (e.g. traffic light "i+1") (block 313). The algorithm then executes the loop again for the next designated traffic light (e.g. traffic light "i+1"). If the active traffic light is the last traffic light in the sequence than block (319) is executed and the green light time (203 in FIG. 2) duration for each traffic light, is amended based on the usage time measurements.

In one example the usage time is changed by the following procedure. For the traffic light with the maximum usage percentage increase the green light time (203 in FIG. 2) by one unit. If there is more than one traffic light with the same usage percentage as the maximum usage percentage, than randomly choose one of the traffic lights with the maximum usage percentage. For the traffic light with the minimum usage percentage decrease the green light time (203 in FIG. 2) by one unit. If there is more than one traffic light with the same usage percentage as the minimum usage percentage, than randomly choose one of the traffic lights with the minimum usage percentage. The above described procedure ensures that the total green light time of all the traffic lights is constant, which maintains traffic flow across multiple intersections. One example of a time unit is one second. Another example of a time unit is 5 seconds.

In an additional example the usage time is changed by the following procedure. If the total duration of all green light is smaller than a predefined maximum total green light time than for the traffic light with the maximum usage percentage increase the green light time (203 in FIG. 2) by one unit. If there is more than one traffic light with the same usage percentage as the maximum usage percentage, than randomly choose one of the traffic lights with the maximum usage percentage. If the total duration of all green light is larger than a predefined minimum total green light time than for the traffic light with the minimum usage percentage decrease the green light time (203 in FIG. 2) by one unit. If there is more than one traffic light with the same usage percentage as the minimum usage percentage, than randomly choose one of the traffic lights with the minimum usage percentage. The above described procedure ensures that the total green light time of all the traffic lights is kept within the bounds defined by minimum total green light time and maximum green light time. One example of a time unit is one second. Another example of a time unit is 2 seconds. One example of minimum total green light is 40 seconds. An example of maximum green light time is 120 seconds.

Hence one example is a method for controlling traffic signals comprising: a green light time for each traffic light; measuring usage percentage for each traffic light; increasing the green light time of the traffic light with maximum usage percentage; and reducing the green light time of the traffic light with minimum usage percentage. In another example above method is continuously repeated. In another example the increase in green light time is a fixed duration. In a further example the fixed duration is one second. In an alternative example the fixed duration is between one second to five seconds. In another example the reduction in green light time is a fixed duration. In an additional example the increase and reduction in green light time are equal and of a fixed duration. Another example is a method for controlling traffic signals comprising of; a total green light time; a maximal total green light time; a minimal total green light time; a green light time for each traffic light; measuring usage percentage for each traffic light; if the total green light time is smaller than the maximal green light time than increasing the green light time of the traffic light with maximum usage percentage; and if the total green light time is smaller than the maximal green light time than reducing the green light time of the traffic light with minimum usage percentage. In another example the method is continuously repeated. In another example the increase in green light time is a fixed duration. In another example the reduction in green light time is a fixed duration. In an additional example the increase and reduction in green light time are equal and of a fixed duration. In these examples a change in the green light time in one direction changes the ratio of green light time between the lanes.

In another example the traffic sensor is adapted to provide traffic usage. State of art traffic sensors provide an indication of traffic presence. For example an induction sensor will provide an electrical signal when a vehicle is above the induction loop. In this example, a timer or clock is added to the readout electronics and the electrical output provides an indication of the ratio of the time that vehicles where present above the induction loop to the time that no vehicle was above the induction loop. In additional examples the inductor loop sensor can be replaced with any of; video sensor; acoustic sensor; pressure sensor; vibration sensor. In another example the electronic output is generated by an analog electronic circuit. In one example the output of the induction loop reading is connected to a capacitor and the output increases over time. A clock periodically samples the capacitor and resets the capacitor voltage. The sample output is the required traffic usage signal. In another example the electronic output can be implemented using a digital electronic circuit. The digital electronic circuit receives the sampled output of the induction loop sensor and the timer or clock signal and calculates the ratio of time the vehicles are over the induction loop compared to the time the sensors are not over the induction loop.

In another example the device for measuring traffic usage comprising of; a traffic sensor; wherein said sensor provides a signal when a vehicle is present in the vicinity of the sensor; a timer device; wherein said timer device provides an electrical signal at a fixed interval; and wherein the output signal of the device is proportional to the duration that a vehicle was present in the vicinity of the traffic sensor to the duration that no vehicle was present in the vicinity of the sensor. In a further example the device output is an analog signal. In a further example the device output is a digital signal.

In another example the method for controlling traffic signals comprises of; a total green light time; a maximal total green light time; a minimal total green light time; a green light time for each traffic light; measuring usage percentage for each traffic light; if the total green light time is smaller than the maximal green light time than increasing the green light time of the traffic light with maximum usage percentage; and if the total green light time is larger than the minimal green light time than reducing the green light time of the traffic light with minimum usage percentage.

The algorithm balances the usage for each green light by passing time units from the minimum used direction to the maximum used direction. The algorithm changes only the green light duration plan of a traffic light junction, and does not change any other aspect of the junction control, thus do not impair safety of passengers in the junction. Common Traffic Light Junctions have one or more predefined green light duration plan which can change according to the time of the day. This algorithm manages and changes the plan continuously to find the plan that optimizes the traffic flow for any predefined green light duration.

The above described method can be implemented in a traffic intersection. In one example a traffic intersection comprising; two or more intersecting roads; two or more traffic lights; a traffic light controller executing a method for controlling traffic signals comprising: a green light time for each traffic light; measuring usage percentage for each traffic light; increasing the green light time of the traffic light with maximum usage percentage; and reducing the green light time of the traffic light with minimum usage percentage. In a further example the method for controlling traffic signals is continuously repeated. In a further example the increase in green light time is a fixed duration. In a further example the reduction in green light time is a fixed duration. In a further example the increase and reduction in green light time are equal and of a fixed duration.

The described algorithm expands on the state of art and resolves the deficiencies of existing solutions namely; the algorithm can be implemented in the existing infrastructure of controllers and single sensor per lane, and the algorithm maintains the traffic flow cycle to prevent disruption to traffic. It is clear that in the implementation of the apparatus and method, many modifications could be made to the system that carries out the described algorithm. It should be considered that all modifications and alterations of the system and algorithm are falling within the scope of this document.

With reference to FIG. 4, the operations and algorithms described herein can be implemented as executable code within a micro-controller 400 or control device having processor circuit 401, or stored on a standalone computer or machine readable non-transitory tangible storage medium that are completed based on execution of the code by a processor circuit implemented using one or more integrated circuits. Example implementations of the disclosed circuits include hardware logic that is implemented in a logic array such as a programmable logic array (PLA), a field programmable gate array (FPGA), or by mask programming of integrated circuits such as an application-specific integrated circuit (ASIC). Any of these circuits also can be implemented using a software-based executable resource that is executed by a corresponding internal processor circuit such as a micro-processor circuit (not shown) and implemented using one or more integrated circuits, where execution of executable code stored in an internal memory circuit causes the integrated circuit(s) implementing the processor circuit to store application state variables in processor memory, creating an executable application resource (e.g., an application instance) that performs the operations of the circuit as described herein. Hence, use of the term "circuit" in this specification refers to both a hardware-based circuit implemented using one or more integrated circuits and that includes logic for performing the described operations, or a software-based circuit that includes a processor circuit (implemented using one or more integrated circuits), the processor circuit including a reserved portion of processor memory for storage of application state data and application variables that are modified by execution of the executable code by a processor circuit. A memory circuit 402 can be implemented, for example, using a non-volatile memory such as a programmable read only memory (PROM) or an EPROM, and/or a volatile memory such as a DRAM, etc. The micro-controller 400 can be considered to be part of the traffic light controller noted above that is operatively connected with the sensors 103 and the traffic lights 101.

What is claimed is:

1. A method for controlling two or more traffic lights, the method comprising the steps of:

for every time period:

operating each of the traffic lights with a green light for a green light time period;

for each traffic light and time period:

detecting and accumulating data regarding a passage of a vehicle past each traffic light with a traffic sensor associated with each traffic light;

at end of a current time period:

calculating a usage percentage for each traffic light as a sum of the accumulated data regarding the passage of all vehicles through the associated traffic light divided by the green light time period of the associated traffic light;

at an immediately following time period:

increasing the green light time of the traffic light with maximum usage percentage;

reducing the green light time of the traffic light with minimum usage percentage;

operating the traffic lights with the increased or decreased green light time; and wherein the method is continuously repeated.

2. The method of claim 1, where increasing the green light time is conducted with a fixed duration.

3. The method of claim 1, where decreasing the green light time is conducted with a fixed duration.

4. The method of claim 1, where the increasing or reducing the green light time is conducted with equal and fixed duration.

5. A method for controlling two or more traffic lights, each traffic light having a parameter of a total green light time; a parameter of a maximal green light time; a parameter of a minimal green light time; a counter for a green light time, the method comprising the steps of:

calculating a usage percentage for each traffic light as a sum of the number of vehicles passing through an associated traffic light divided by the total green light time of the associated traffic light;

if the parameter of a total green light time is smaller than the parameter of a maximal green light time then increasing the counter of a green light time of the traffic light with maximum usage percentage;

if the parameter of a total green light time is larger than the parameter of a minimal green light time then reducing the counter of a green light time of the traffic light with minimum usage percentage; and wherein the method is continuously repeated.

6. The method of claim 5, where an increase in a counter of a green light time is conducted with a fixed time duration.

7. The method of claim 5, where a decrease in a counter of a green light time is conducted with a fixed time duration.

8. The method of claim 5, where an increase or a decrease in a counter of a green light time is conducted with an equal and fixed time duration.

9. A device for measuring traffic usage comprising of;

a traffic sensor; wherein said sensor provides a signal when a vehicle is present in the vicinity of the sensor;

a timer device; wherein said timer device provides an electrical signal at a fixed interval; and wherein an output signal of the device for measuring traffic usage is a ratio of the duration that a vehicle was present in the vicinity of the traffic sensor to the duration that no vehicle was present in the vicinity of the sensor.

10. The device of claim 9, where the device output for measuring traffic usage is an analog signal.

11. The device of claim 9, where the device output for measuring traffic usage is a digital signal.

12. A traffic light controller for controlling two or more traffic lights, comprising:

a computing unit including a green light time counter for each traffic light, each traffic light including at least a red light, a green light, and a traffic sensor; wherein the traffic sensor is in communication with the computing unit and provides a signal to the computing unit every time a vehicle crosses the sensor; wherein the computing unit is constructed and arranged to execute a method for controlling traffic signals comprising:

for each traffic light:

calculating usage percentage from communicated sensor signals, the usage percentage being as a sum of the number of vehicles crossing the sensor of an associated traffic light divided by a green light time of the associated traffic light;

increasing the green light time counter of the traffic light with maximum usage percentage; and reducing the green light time counter of the traffic light with minimum usage percentage;

wherein the method for controlling traffic signals is continuously repeated.

13. A traffic light controller of claim 12, where increasing the green light time counter is conducted with a fixed time duration.

14. A traffic light controller of claim 12, where decreasing the green light time counter is conducted with a fixed time duration.

15. A traffic light controller of claim 12, where the increasing or reducing the green light time counter is conducted with an equal and fixed time duration.

* * * * *